US005613463A

United States Patent [19]

Stokes

[11] Patent Number: 5,613,463

[45] Date of Patent: Mar. 25, 1997

[54] NUMBERING DEVICE

[76] Inventor: William T. Stokes, 1125 Robin Way, Sunnyvale, Calif. 94087

[21] Appl. No.: 368,299

[22] Filed: Jan. 3, 1995

[51] Int. Cl.[6] ..... G09F 11/04

[52] U.S. Cl. ..... 116/315; 40/495; 116/307; 116/311; 116/318; 116/201

[58] Field of Search ..... 116/307, 311, 116/312, 313, 314, 315, 316, 317, 318, 223, 201; 40/495, 115

[56] References Cited

U.S. PATENT DOCUMENTS

| | | | |
|---|---|---|---|
| 162,992 | 5/1875 | Amsden et al. | 40/495 X |
| 730,685 | 6/1903 | Norman | 40/115 |
| 1,380,227 | 5/1921 | McGlothlen | 40/495 |
| 1,602,170 | 10/1926 | Ricca | 40/495 |
| 2,774,158 | 12/1956 | Tamoschat | 116/317 X |
| 4,037,719 | 7/1977 | Perlmutter | 116/314 X |

*Primary Examiner*—William A. Cuchlinski, Jr.
*Assistant Examiner*—Willie Morris Worth
*Attorney, Agent, or Firm*—Thomas M. Freiburger

[57] ABSTRACT

A device for assigning numbers to products having casings, such as electronic calculators, has at least two digit wheels, each preferably having digits 0 through 9. One of the digit wheels is transparent, while the other may be opaque, with a light background. The digits on each of the two wheels are offset from radial lines such that two-digit numbers can be made with selected digits juxtaposed. If three digit wheels are included the tens wheel has digits centered on radial lines. The casing of the product to be numbered has a number viewing window and an internal peg on which the digit wheels are held and can be rotated for adjustment, as well as at least one peg or pin for engaging registry holes to align and maintain the digit wheels in proper position. In a preferred embodiment the digit wheels are manipulated to the proper number by removing the back from the casing.

14 Claims, 4 Drawing Sheets

NUMBERING DEVICE

BACKGROUND OF THE INVENTION

The invention is concerned with application of individual numbers to products such as hand-held electronic calculators, in such a way as to allow changing of a number when necessary.

There are a number of situations wherein each of a series of similar or identical items needs to be uniquely identified, so that all of the items in the collection can be accounted for. One situation where this holds true is in schools, where electronic calculators are used, but not owned, by a class of students. When the calculators are turned in to the teacher, if a calculator is missing or broken it should be known who is responsible. Thus, teachers have often used felt tip pens or paint to put a number on the back of each of a collection of student calculators, such as numbers 1 through 30. This practice has some disadvantages: the wearing off of the ink or paint, the time required for applying the numbers, the possibility that students could change the numbers using a similar pen, etc.

Another possibility is the use of stick-on labels, but again, these are subject to tampering and peeling off by students, and a supply of printed labels, with multiple copies of the same numbers, would have to be maintained by the teacher.

For these reasons, it would be desirable if the manufacturer would apply a unique number to each of a group of calculators intended for a school class. However, this is difficult from the point of view of the manufacturer, not only because a different number must be silk-screened, embossed, etched or otherwise applied to each calculator, but also because the number of calculators ordered for different schools and classes varies, causing obvious problems of stock and inventory. Also, if a calculator from a particular class is lost or broken, and a replacement calculator is ordered, the manufacturer would have to provide a replacement calculator bearing the same number as the calculator to be replaced, again with obvious problems of inventory and cost.

There has been no economical and convenient solution to this problem of identifying individual classroom calculators, as well as other, similar situations wherein a series of identical items are lent to students or other groups, until the present invention described below.

SUMMARY OF THE INVENTION in the invention described herein, a device for assigning numbers to products having casings, such as electronic calculators, has two or more digit wheels, each with digits 0 through 9 in circular array. One of the digit wheels is transparent while the other is opaque, preferably with a white background. The digits on each wheel are offset from radial lines such that two-digit numbers can be made with selected digits juxtaposed and properly aligned. The casing of the product to be numbered has a number viewing window and an internal peg on which the digit wheels rotate, as well as one or more pegs or pins for engaging registry holes to align and maintain the digit wheels in proper position. In a preferred embodiment the digit wheels are manipulated to the proper number by removing the back from the casing, followed by reattachment of the back.

Although a preferred embodiment described below includes only two digit wheels, one with a transparent field and one with an opaque field, this being sufficient to handle nearly all classroom situations, it is clear that more than two digit wheels can be used. Three digit wheels, two transparent and one opaque, overlaid as described above, can provide numbering from 1 (or 0) to 999. In this case, one digit wheel has its digits centered on radials, while another wheel has digits offset left and the third wheel has digits offset right.

It is therefore an object of the invention to provide a simple numbering system for a multiplicity of similar items of value, such as classroom calculators on loan to students, or other items which need to be individually identified so as to account for each item. These and other objects, advantages and features of the invention will be apparent from the following description of preferred embodiments, considered along with the accompanying drawings.

DESCRIPTION OF PREFERRED EMBODIMENTS

Figure 1:
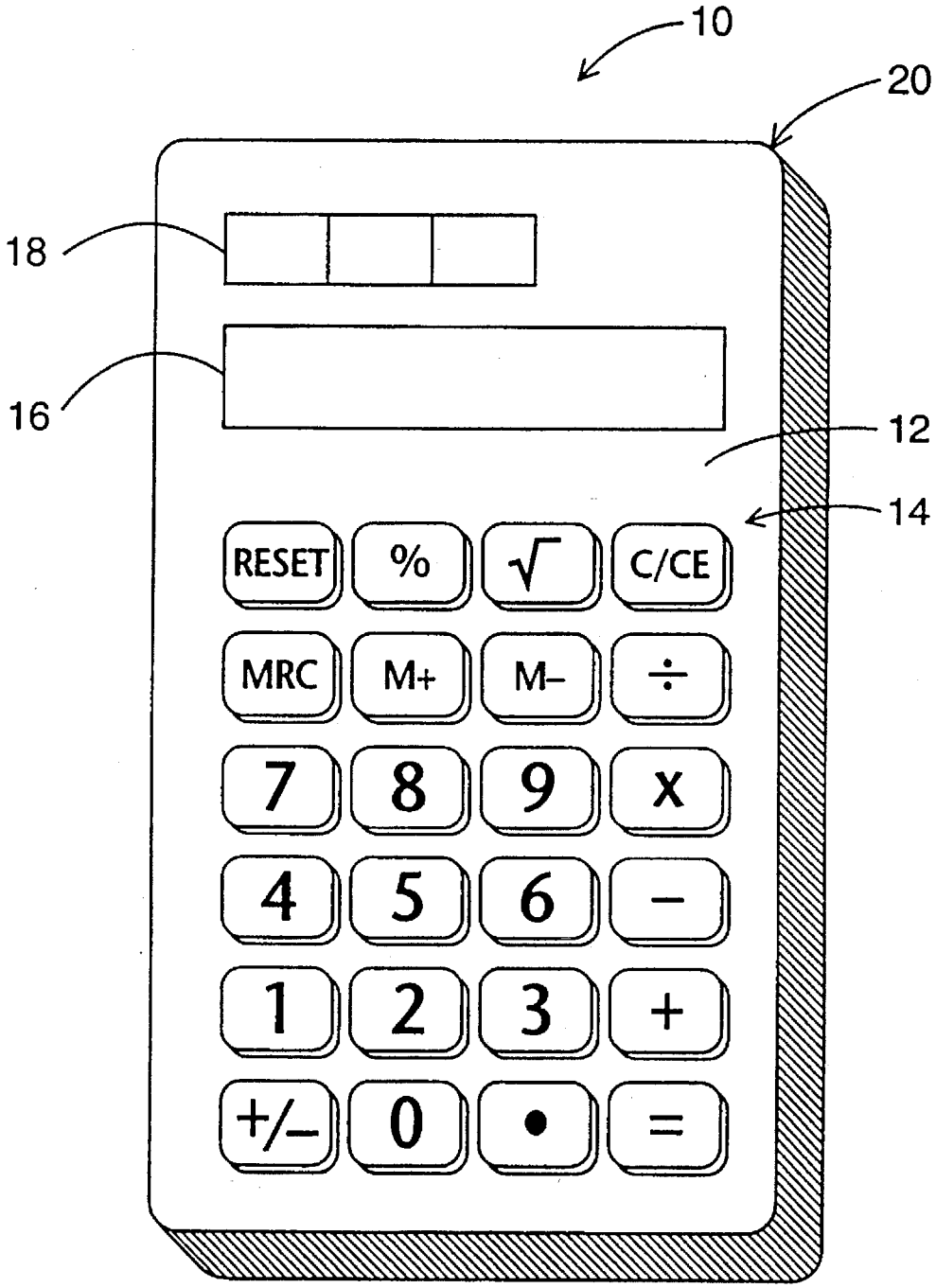
FIG. 1 is a frontal view showing an electronic calculator which may be part of a set of school-owned calculators used by students in a mathematics classroom.

FIG. 1 shows the front of a calculator 10 which embodies the principles of the present invention. The calculator 10 has a front panel 12, a keyboard 14, a liquid crystal display 16 and a solar panel or photovoltaic panel 18, typical of small hand-held calculators of this general type, all contained in a casing 20. Although the calculator 10 is shown with special features which are reflected in the keyboard 14, these features are the subject of a copending application of the applicant, and do not form a part of the subject matter described herein.

The calculator 10 is of typical size for a hand-held student calculator for use in a classroom, and this may be about 5 to 8 cm in width and about 9 to 12 cm in length. As can be appreciated, the calculator can be smaller if desired, but a practical minimum size is dictated primarily by ease and convenience of use of the keyboard 14.

Figure 2:
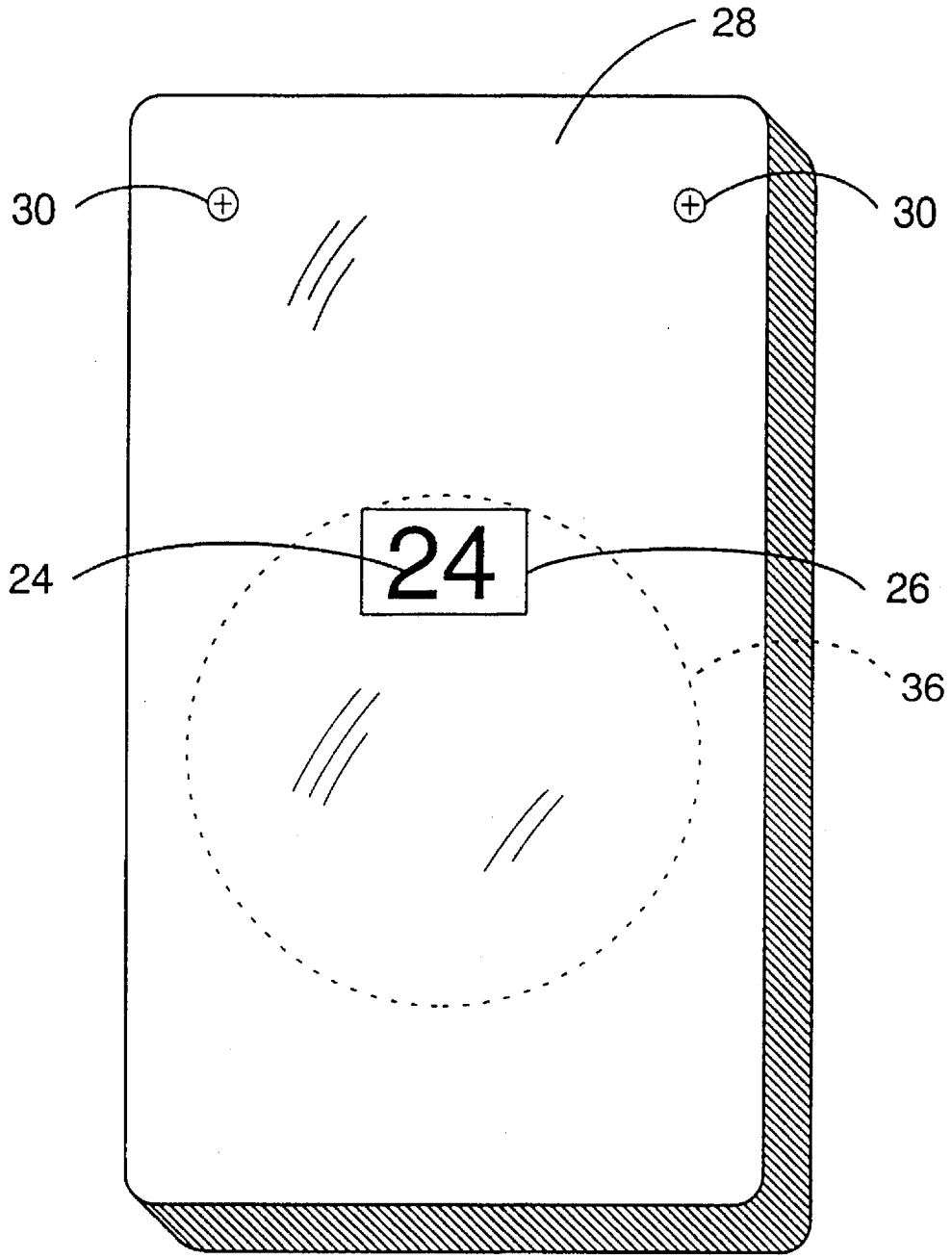
FIG. 2 is a rear view of a classroom calculator, showing a number applied to the calculator through the system of the present invention.

FIG. 2 shows a calculator identifying number 24, displayed through a window 26 in a back panel 28 of the calculator. The back panel 28 is removable, preferably via small machine screws 30 as indicated, as is fairly typical of hand-held calculators having a plastic casing as in the calculator 10.

As explained above, the identifying number 24 provides, for a teacher or other owner, supervisor or controller of a multiplicity of similar calculators 10 or other products, a means of accounting for each calculator used in a class. The identifying numeral may be changed if needed, and in the case of a replacement calculator, it can be adjusted to the same identifying number of a calculator which has been lost or broken and which is being replaced. The back panel 28 of the calculator may be removed from the casing by removal of the small machine screws 30. These are deliberately made quite small so that, in a preferred embodiment, an unusually small screw driver is needed to remove the back panel. Thus, a teacher or other administrator or lender of items such as calculators has access to removal of the back panel 28, but a student in a classroom, as a practical matter, generally does not.

Figure 3:
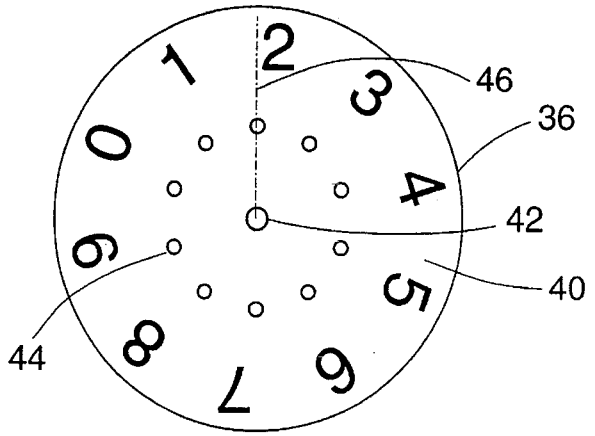
FIG. 3 is a plan view showing a units digit wheel forming part of the numbering system of the invention.
Figure 4:
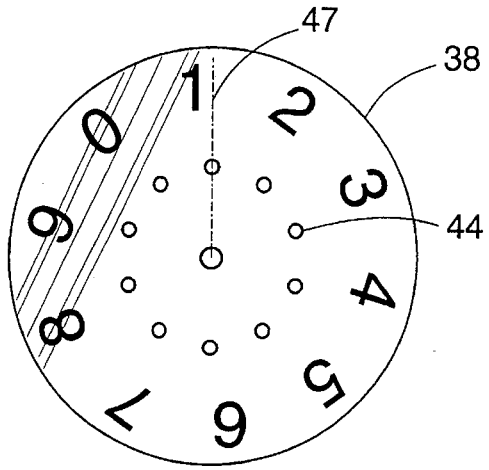
FIG. 4 is a view showing a tens digit wheel which cooperates with the units digit wheel of FIG. 3 in the system the invention.
Figure 5:
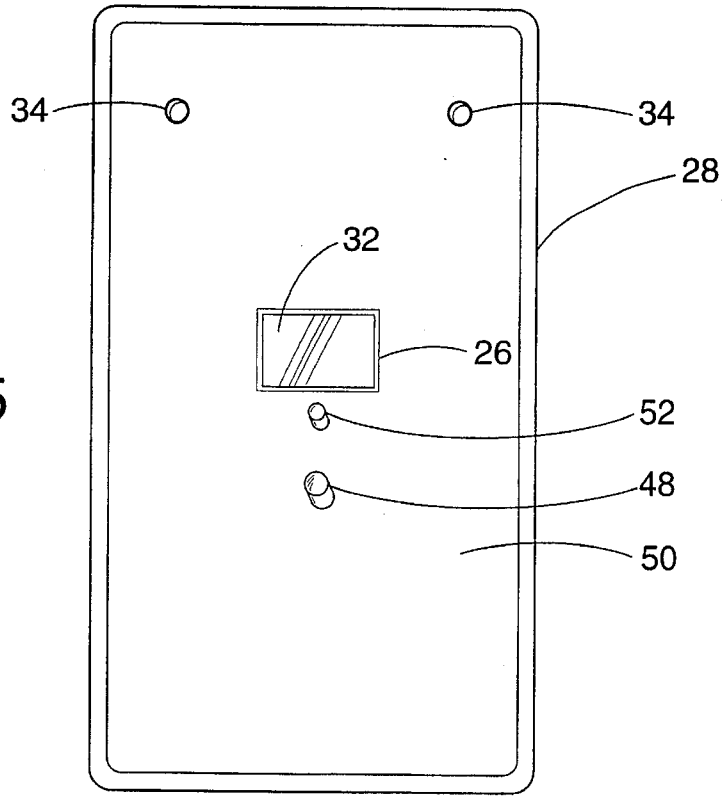
FIG. 5 is a view showing the inside back of a calculator, e.g. the inside of the back panel seen in FIG. 2, the view being at a slightly oblique angle.

FIGS. 3 through 6 show apparatus for displaying a selected number through the window 26. As shown in FIG. 5, revealing the inside of the back panel 28, the window 26 preferably has a transparent plastic insert 32, for protection against manipulation of the numbers as well as protection against dust and other contaminants. The window panel 32 may be snapped into place in the window opening 26, or secured by adhesion, heat bonding or other appropriate and efficiently accomplished means. FIG. 5 also shows openings 34 through the back panel, for receipt of the machine screws 30 shown in FIG. 2.

FIGS. 3 and 4 show a units digit wheel 36 and a tens digit wheel 38. As noted above, a further hundreds digit wheel can be included if needed for a particular application. Two, three, four or more digit wheels can be included, for different digit places, or even a single digit wheel can be used for certain applications. The digit wheels are shown circular, but they could be many-sided polygons if desired. The term generally circular is intended to include such shapes. Also, two digit wheels of the numbering device are sometimes referred to herein as first and second digit wheels; this is not intended to preclude there being a third (or additional) digit wheel, which may be transparent and positioned between the first and second digit wheels.

One of the digit wheels, the units digit wheel 36 in this embodiment, has an opaque field 40, which preferably is white or a light color, with digits 0 through 9 printed or otherwise applied onto the surface of the circular wheel. In the center of the digit wheel 36 is an opening 42 which facilitates centering of the digit wheel and rotation about a center point, for adjustment. Outside the center opening 42, and arranged preferably in a circular pattern, is a series of further openings 44.

As can be seen in both FIGS. 3 and 4, the digits of each digit wheel are offset left or right of a radial on the digit wheel (in the case of only two digits), FIG. 3 indicating a Iradial 46 and FIG. 4 a radial 47. This facilitates proper alignment of the digits in the units and tens places when the two digit wheels 36 and 38 are overlaid (if there are three digit wheels, one has radially-centered digits). In this embodiment, the tens digit wheel 38 can be transparent, while the units digit wheel 36 has the opaque field 40; however, this situation can be reversed so that the units wheel 36 overlies the tens wheel 38 if desired. In either event, one of the digit wheels, that wheel which is to be overlaid on the other, is transparent (or if there are three digit wheels, two are transparent). It should be noted that both (or all) digit wheels can be transparent, so long as the calculator when closed presents a plain, light background behind the window 26.

Figure 6:
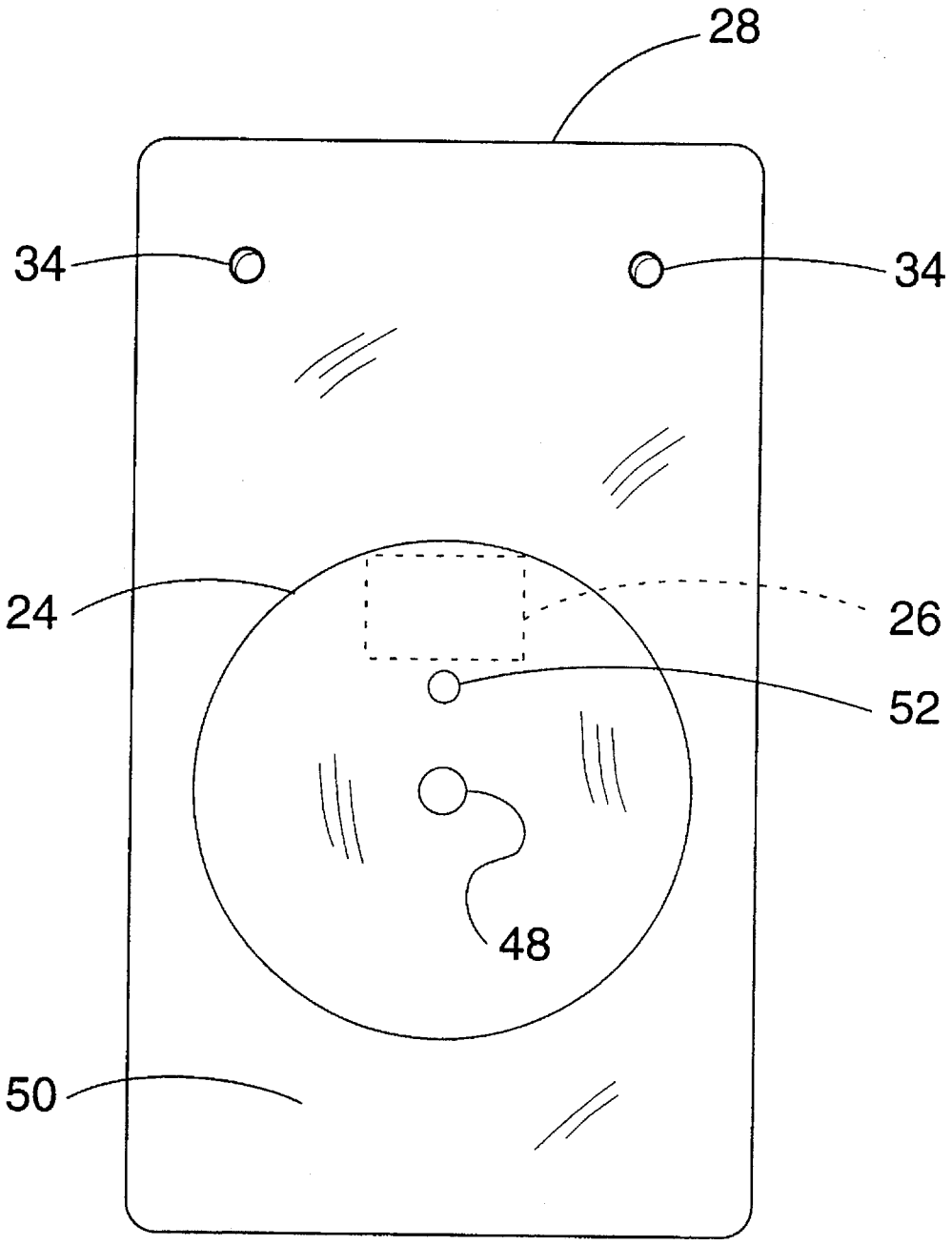
FIG. 6 is a view similar to FIG. 5, but showing the back panel with the digit wheels in position.

As can be seen from FIG. 5 and as also illustrated in FIG. 6, the digit wheels 36 and 38 are placed onto a centering peg 48 extending inwardly on the inside surface 50 of the back panel 28. Although the centering peg 48 could be provided on structure associated on the other side of the calculator casing, rather than on the back panel 28, the structure inside the casing usually will be the back of the keyboard, i.e. the back of a printed circuit board. It is more convenient and preferred that the centering peg be incorporated on the inside surface of the back panel 28 as illustrated, in the case of a hand-held calculator of this general configuration. In the case of other products, it may be preferable to locate the peg on another surface.

The digit wheels 36 and 38 are positioned over this centering peg 48, face down as viewed in FIG. 5, in other words, with the numbers facing toward the rear of the calculator so as to be correctly visible through the viewing window 36. FIG. 6, showing the inside of the back panel 28 with digit wheels in place, indicates the position of the hidden viewing window 26 in dashed lines.

An additional peg or boss 52 is included on the inside surface of the back panel 28 in this preferred embodiment, for engaging through alignment holes 44 of the two overlaid digit wheels 36 and 38. This forms a convenient means of registering the overlaid digit wheels so the numerals are correctly aligned in juxtaposed position as shown in FIG. 2, but alternative means for holding the digit wheels in place could be employed. As an example, the two digit wheels could be positioned as accurately as possible by hand, in overlaid configuration, with the screwing down of the back panel onto the casing applying pressure and pinching the two digit wheels to hold them in position. In the embodiment shown, the height of the registry panel or peg 52 is sufficient that neither of the digit wheels 36 or 38 can become rotated out of position by jarring or other motion of the calculator.

In FIG. 6 the number wheels are shown in position against the inside surface 50 of the calculator back panel 28. Only the back, opaque side of the units digit wheel 36 is visible, but the pegs or pins 48 and 52 can be seen holding these digit wheels in place.

In one preferred embodiment, for a calculator having a width of about 68 mm and a length of about 113 mm, the digit wheels are about 60 mm in diameter. The number viewing window may be about 14.5 mm by 10 mm, with the bottom edge of the window positioned about 52 mm up from the bottom edge of the calculator (the drawings herein show the window and digit wheels positioned higher). The distance between the centering peg 48 and the registry pin 52 may be about 15 mm. Of course, the shape and size of the calculator (or other product) may be very different from what is shown, and the above dimensions may be varied accordingly.

It should also be understood that the digit wheels could have different formats for presentation of a unique identifier through the display window. As examples, the "digits" as referred to herein and in the claims could be alphabet letters, so that "AA", "AB", etc. are displayed; or the "digits" of one wheel could be multiple digits, e.g. 10 through 20 could appear on one wheel and units on the other, to display 100 through 200 if that is the format desired. There are many other possibilities.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A numbering device for assigning selected multiple-digit numbers to a product which includes a casing, comprising:

a first generally circular digit wheel having a plurality of digits arranged on the wheel in a generally circular pattern near the outer edge of the wheel, the first digit wheel being generally transparent so as to permit viewing of background behind the first digit wheel, a second generally circular digit wheel generally the same size as the first digit wheel and having a plurality of digits arranged generally in a circular pattern near the outer edge of the second digit wheel, means for mounting the two digit wheels, with the first digit wheel overlying the second digit wheel, in overlying registry within the casing such that the digits face outwardly of the casing, viewing window means in the casing, for permitting viewing of selected juxtaposed digits from the first and second digit wheel, and the first and second digit wheels having their digits offset from radials of the digit wheel, with digits of one of the digit wheels being offset to the left and the digits of the other digit wheel being offset to the right, whereby, when digits are selectively juxtaposed in the casing so as to be viewable through the viewing window means, they are included in a selected number having digits in substantially proper and parallel arrangement.

2. The numbering device of claim 1, wherein the product comprises an electronic calculator, the viewing window means being in the back panel of the calculator.

3. The numbering device of claim 2, wherein the viewing window means includes a substantially transparent plastic window barrier protecting the digit wheels inside the casing.

4. The numbering device of claim 1, wherein the first digit wheel includes digits for the tens position, being offset to the left of radials of the digit wheel, and wherein the second digit wheel has digits positioned for the units position and being offset to the right of radials of the digit wheel.

5. The numbering device of claim 1, wherein the means for mounting the digit wheels in the casing comprises a hole through the center of each digit wheel, and a peg formed at the inside surface of a panel of the casing and positioned to engage through the hole in the digit wheels.

6. The numbering device of claim 5, further including a series of registry holes arranged in a circular pattern on each of the digit wheels and in similar positions on both digit wheels, and at least one nipple or pin in the casing, at a fixed position in the casing, positioned to engage through a registry hole of each of the digit wheels when a number has been selected by manipulation of the two digit wheels in the casing, to hold the digit wheels in position with the digits in proper alignment.

7. The numbering device of claim 1, wherein the product's casing has a panel with means for removing the panel using a tool, and wherein the two digit wheels are fully contained within the casing and inaccessible to a user when the panel is secured in the casing.

8. The numbering device of claim 7, wherein the product comprises an electronic calculator, the viewing window means being in the back panel of the calculator, the calculator being one of a series of identical calculators for use in a classroom.

9. The numbering device of claim 1, further including background means for presenting a plain, light background against which a selected number can be viewed through the viewing window means.

10. The numbering device of claim 9, wherein the background means comprises a plain, light-colored surface in the calculator casing, positioned behind the viewing window means when the casing is closed, both digit wheels being transparent, such that the plain background means is seen through the two transparent digit wheels when a selected number is viewed through the viewing window means.

11. The numbering device of claim 9, wherein the background means comprises the second digit wheel being substantially opaque, the first digit wheel being overlaid over the second digit wheel so that a digit of the second digit wheel is visible through the first digit wheel.

12. The numbering device of claim 1, wherein only two digit wheels are included, so that numbers from zero to 99 may be assigned to the product and displayed through the viewing window means.

13. A method for placing identifying numbers on a series of identical calculators for classroom use, comprising performing the following steps for each of the series of calculators:

providing a pair of digit wheels, each having a series of digits arranged in circular fashion on the face of the digit wheel, at least one digit wheel being generally transparent, the two digit wheels being overlaid within a casing of the calculator, which has a panel with a viewing window capable of revealing digits side by side, one digit from each digit wheel, removing the panel of the calculator and manipulating and repositioning the two digit wheels, and including selecting a number and arranging the digit wheels such that said one generally transparent digit wheel overlies the other digit wheel and such that the selected number is formed with digits juxtaposed from each of the digit wheels, and positioning the two digit wheels such that the selected and formed number is visible through the viewing window of the panel, and fixing the two digit wheels in position and resecuring the panel on the calculator.

14. The method of claim 13, wherein each of the digit wheels has its digits offset to the side from radials of the digit wheel, the two digit wheels having digits which are offset in opposite directions, such that when digits of the two digit wheels are juxtaposed to form a number, the numbers are in proper position and alignment.

* * * * *